US010506361B1

(12) United States Patent
Pallamsetty et al.

(10) Patent No.: US 10,506,361 B1
(45) Date of Patent: Dec. 10, 2019

(54) IMMERSIVE SOUND EFFECTS BASED ON TRACKED POSITION

(71) Applicant: QUALCOMM Incorporated, San Diego, CA (US)

(72) Inventors: Venkata Rajesh Pallamsetty, Kurnool (IN); Srujana Veeramalla, Hyderabad (IN); Dheebu Kaithavana John, Hyderabad (IN)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 16/204,240

(22) Filed: Nov. 29, 2018

(51) Int. Cl.

| | |
|---|---|
| ***H04S 7/00*** | (2006.01) |
| ***H04R 5/02*** | (2006.01) |
| ***H04S 3/00*** | (2006.01) |
| ***H04R 5/04*** | (2006.01) |

(52) U.S. Cl.
CPC ..... *H04S 7/303* (2013.01); *H04R 5/02* (2013.01); *H04R 5/04* (2013.01); *H04S 3/008* (2013.01); *H04S 2400/01* (2013.01)

(58) Field of Classification Search
CPC .. H04R 3/002; H04R 3/00; H04R 5/02; H04S 7/303; H04S 3/008; H04S 2400/01
USPC ..... 381/303, 71.6, 335, 334, 387
See application file for complete search history.

(56) References Cited

U.S. PATENT DOCUMENTS

2010/0323793 A1* 12/2010 Andall ..... H04S 7/303 463/35
2015/0208166 A1* 7/2015 Raghuvanshi ..... H04R 3/002 381/71.6
2018/0063664 A1* 3/2018 Horbach ..... G06F 3/04817

* cited by examiner

*Primary Examiner* — Paul Kim
*Assistant Examiner* — Ubachukwu A Odunukwe
(74) *Attorney, Agent, or Firm* — Holland & Hart LLP

(57) ABSTRACT

A device in control of a speaker system may receive from one or more sensors information indicative of a user's location and/or body position. The device may use the information to the determine the user's location and/or body position and may adjust the outputs of speakers in the sound system. For example, the device may instruct a speaker to switch from outputting a first audio channel at a first volume level to outputting a second audio channel at a second volume level. If the user changes location or body position, the device may adjust the speaker's output to accommodate the user's new location and/or body position.

16 Claims, 8 Drawing Sheets

100

200

500

600

IMMERSIVE SOUND EFFECTS BASED ON TRACKED POSITION

BACKGROUND

The following relates generally to wireless communications, and more specifically to immersive sound effects based on tracked position.

Wireless communications systems are widely deployed to provide various types of communication content such as voice, video, packet data, messaging, broadcast, and so on. A wireless network, for example a wireless local area network (WLAN), such as a Wi-Fi (i.e., Institute of Electrical and Electronics Engineers (IEEE) 802.11) network may include an access point (AP) that may communicate with one or more wireless or mobile devices. The AP may be coupled to a network, such as the Internet, and may enable a mobile device to communicate via the network (or communicate with other devices coupled to the access point). A wireless personal area network (PAN), which may include a Bluetooth connection, may provide for short range wireless connections between two or more paired wireless devices. For example, wireless devices such as cellular phones may utilize wireless PAN communications to exchange information such as audio signals with wireless headsets.

A sound system may use wired or wireless communications to coordinate the speakers within the system. For example, the sound system may send content and control to the speakers within the system to provide sound from different locations. But the quality of the acoustic experience may vary depending on the location of the user. Techniques for providing an immersive acoustic experience regardless of user location may be desired.

SUMMARY

The described techniques relate to improved methods, systems, devices, or apparatuses that support immersive sound effects based on tracked position. A device in control of a speaker system may receive (e.g., from one or more sensors) information indicative of a user's location and/or body position. The device may use the information to the determine the user's location and/or body position and may adjust the outputs of speakers in the sound system (e.g., based on the user's location and/or body position). For example, the device may instruct a speaker to switch from outputting a first audio channel at a first volume level to outputting a second audio channel at a second volume level. If the user changes location or body position, the device may adjust the speaker's output to accommodate the user's new location and/or body position.

A method of providing adaptive acoustics is described. The method may include selecting a first speaker of a sound system in an area to output a first channel at a first sound level based on a first spatial position of a user, receiving movement information associated with the user from one or more sensors in the area, determining, based on the movement information, that the user moved from the first spatial position to a second spatial position in the area, and adjusting the first speaker to output at least one of a second channel different than the first channel or a second sound level different than the first sound level based on determining that the user moved from the first spatial position to the second spatial position in the area.

An apparatus for providing adaptive acoustics is described. The apparatus may include a processor, memory in electronic communication with the processor, and instructions stored in the memory. The instructions may be executable by the processor to cause the apparatus to select a first speaker of a sound system in an area to output a first channel at a first sound level based on a first spatial position of a user, receive movement information associated with the user from one or more sensors in the area, determine, based on the movement information, that the user moved from the first spatial position to a second spatial position in the area, and adjust the first speaker to output at least one of a second channel different than the first channel or a second sound level different than the first sound level based on determining that the user moved from the first spatial position to the second spatial position in the area.

Another apparatus for providing adaptive acoustics is described. The apparatus may include means for selecting a first speaker of a sound system in an area to output a first channel at a first sound level based on a first spatial position of a user, receiving movement information associated with the user from one or more sensors in the area, determining, based on the movement information, that the user moved from the first spatial position to a second spatial position in the area, and adjusting the first speaker to output at least one of a second channel different than the first channel or a second sound level different than the first sound level based on determining that the user moved from the first spatial position to the second spatial position in the area.

A non-transitory computer-readable medium storing code for providing adaptive acoustics is described. The code may include instructions executable by a processor to select a first speaker of a sound system in an area to output a first channel at a first sound level based on a first spatial position of a user, receive movement information associated with the user from one or more sensors in the area, determine, based on the movement information, that the user moved from the first spatial position to a second spatial position in the area, and adjust the first speaker to output at least one of a second channel different than the first channel or a second sound level different than the first sound level based on determining that the user moved from the first spatial position to the second spatial position in the area.

In some examples of the method, apparatuses, and non-transitory computer-readable medium described herein, the first spatial position may include operations, features, means, or instructions for selecting a second speaker to output the first channel based on determining that the user may have moved from the first spatial location to the second spatial location.

Some examples of the method, apparatuses, and non-transitory computer-readable medium described herein may further include operations, features, means, or instructions for selecting a third speaker to output a channel previously output by the second speaker based on the second spatial location.

In some examples of the method, apparatuses, and non-transitory computer-readable medium described herein, the second spatial position may include operations, features, means, or instructions for selecting the first speaker to output the second channel based on the spatial location of the user, and selecting the first speaker to output the second sound level based on the second channel and the head orientation of the user.

Some examples of the method, apparatuses, and non-transitory computer-readable medium described herein may further include operations, features, means, or instructions for adjusting the sound level of the first speaker to be a third sound level based on a change in the head orientation of the user.

Some examples of the method, apparatuses, and non-transitory computer-readable medium described herein may further include operations, features, means, or instructions for selecting a second speaker to output the second channel based on the first spatial position of the user, and adjusting the second speaker to not output a channel based on the second spatial position of the user.

In some examples of the method, apparatuses, and non-transitory computer-readable medium described herein, the first spatial position may include operations, features, means, or instructions for selecting the first speaker to output the first channel at the second sound level based on the second head orientation of the user.

Some examples of the method, apparatuses, and non-transitory computer-readable medium described herein may further include operations, features, means, or instructions for determining that the first spatial position includes a first spatial location within a first threshold distance of the first speaker, where selecting the first speaker to output the first channel may be based on the determination that the first spatial location may be within the first threshold distance of the first speaker.

Some examples of the method, apparatuses, and non-transitory computer-readable medium described herein may further include operations, features, means, or instructions for determining that the second spatial position includes a second spatial location within a second threshold distance of a second speaker, and selecting the second speaker to output the first channel may be based on the determination that the second spatial location may be within the second threshold distance of the second speaker.

In some examples of the method, apparatuses, and non-transitory computer-readable medium described herein, the first speaker may be selected to output the first channel while the user may be in the first spatial position and where the first speaker may be selected to output at least one of the adjusted channel or sound level while the user may be in the second spatial position.

Some examples of the method, apparatuses, and non-transitory computer-readable medium described herein may further include operations, features, means, or instructions for detecting at least one of the body of the user, the face of the user, or a mobile device of the user, and determining the first spatial position of the user based on the detection.

Some examples of the method, apparatuses, and non-transitory computer-readable medium described herein may further include operations, features, means, or instructions for identifying the user as one of at least two people within the area based on the detection.

In some examples of the method, apparatuses, and non-transitory computer-readable medium described herein, the first spatial position includes a first spatial location of the user, a first rotational position of the user, a first head orientation of the user, or a combination thereof, and where the second spatial position includes a second spatial location of the user, a second rotational position of the user, a second head orientation of the user, or a combination thereof.

In some examples of the method, apparatuses, and non-transitory computer-readable medium described herein, the one or more sensors include at least one sensor within a head mounted display (HMD) or a mobile device.

DETAILED DESCRIPTION

In some cases, the speakers in a sound system (e.g., a surround sound system) are configured so that the overall acoustic experience is designed for a person located at a single, particular position. For example, the volume and audio channels output by the speakers may be coordinated so that the auditory experience of a listener located at the center of the system is enhanced. But if the person moves within the system (e.g., moves to the side or back of the room), the quality of the immersive acoustic experience may be reduced. In some cases, the reduction of quality may be exacerbated if the listener's head orientation is different than the head orientation for which the speakers are configured (e.g., the listener's head is turned or the listener is facing backwards), which happens in various scenarios (e.g., due to active games, virtual reality examples, from limited seating positions in a room).

According to the techniques described herein, the outputs of speakers in a surround sound system may be adjusted based on the location of the listener and/or the listener's body position (e.g., head and/or body orientation). One or more speakers, or external paired devices, may monitor the listener's position and head orientation using embedded sensors (e.g., cameras, motion tracking sensors, position tracking sensors). Once the location and/or head orientation of the listener is determined, the volume and/or audio channel output by each speaker may be adjusted so that the immersive quality of the acoustic experience is improved. For example, the volume and audio channels mapped to the speakers of the surround sound system may be re-mapped so that they are output by different speakers of the system.

Aspects of the disclosure are initially described in the context of a wireless communications system. Example devices and process flows implementing the described techniques are then discussed. Aspects of the disclosure are further illustrated by and described with reference to apparatus diagrams, system diagrams, and flowcharts that relate to adaptively configuring a sound system based on the position and orientation of a user.

Figure 1:
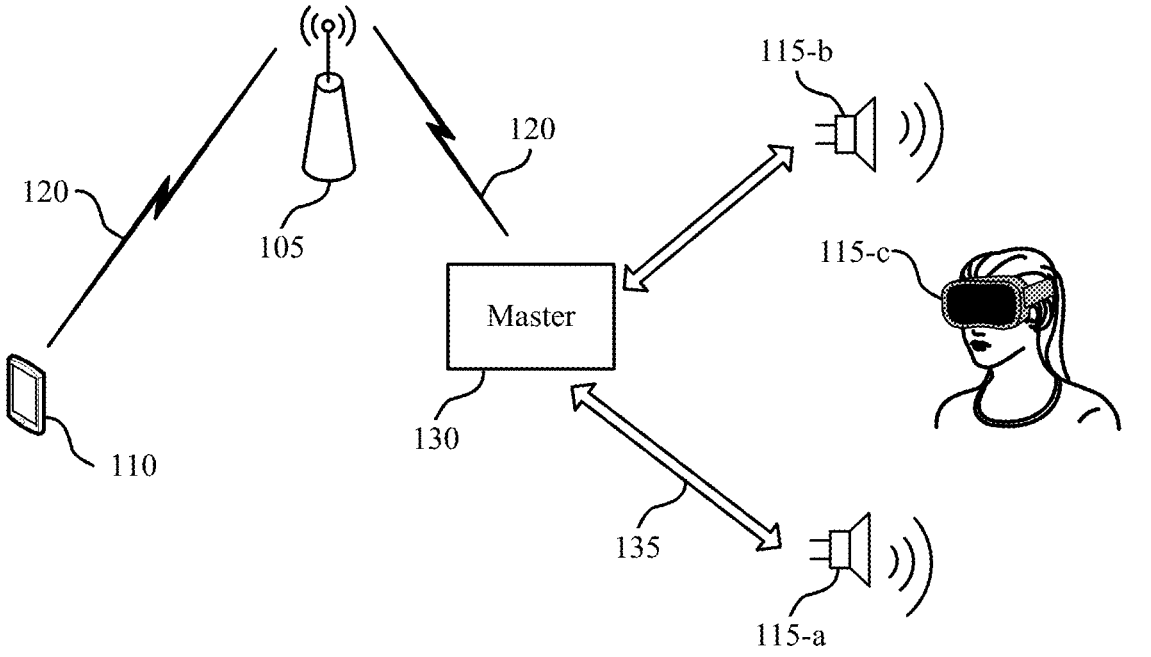
FIG. 1 illustrates a system that supports immersive sound effects configured in accordance with various aspects of the present disclosure.

FIG. 1 illustrates a system 100 (e.g., which may include to refer to or include a wireless personal area network (PAN) or a wireless local area network (WLAN), among others) configured in accordance with various aspects of the present disclosure. The system 100 may include an AP 105, devices 110, and/or paired devices 115 implementing WLAN communications (e.g., Wi-Fi communications) and/or Bluetooth communications. System 100 may also include a master device 130, which may be a Bluetooth device capable of pairing with other Bluetooth devices (e.g., such as paired device(s) 115). The master device 130 may also communicate over the WLAN. In some examples, devices 115 may not be paired, but may otherwise be configured to facilitate and carry out communication between themselves and/or other devices in line with aspects of the present disclosure.

Devices 110 may include cell phones, mobile stations, personal digital assistant (PDAs), other handheld devices, netbooks, notebook computers, tablet computers, laptops, or some other suitable terminology. Although shown as speakers, the paired devices 115-*a* and 115-*b* can be any devices capable of rendering audio content, including speakers, sound bars, earpieces, earbuds, wireless headsets, headphones, display devices, microphones, etc. And although shown as a head mounted display (HMD), the paired device 115-*c* can be any device capable of rendering video, graphic, or visual content, including TVs, computer monitors, electronic picture frames, touch screens, etc. In some cases, a device 110 may be a master device 130, or vice versa.

Bluetooth communications may refer to a short-range communication protocol that is used to connect and exchange information between directly between devices (e.g., between mobile phones, computers, digital cameras, wireless headsets, speakers, keyboards, mice or other input peripherals, and similar devices). Bluetooth systems (e.g., aspects of system 100) may be organized using a master-slave relationship employing a time division duplex protocol having, for example, defined time slots of 625 mu secs, in which transmission alternates between the master device (e.g., master device 130) and one or more slave devices (e.g., paired devices 115). In some cases, a paired device 115 may refer to a slave device in a PAN. The designation of a device as either a master device or slave device may not necessarily indicate a distinction in device capability, but rather may refer to or indicate roles held by the device in the PAN. Generally, a master device may refer to a wireless communication device capable of wirelessly exchanging data signals with another device, and a paired device may refer to a device operating in a slave role, or to a short-range wireless device capable of exchanging data signals with the master device (e.g., using Bluetooth communication protocols).

A Bluetooth device may be compatible with certain Bluetooth profiles to use desired services. A Bluetooth profile may refer to a specification regarding an aspect of Bluetooth-based wireless communications between devices. That is, a profile specification may refer to a set of instructions for using the Bluetooth protocol stack in a certain way, and may include information such as suggested user interface formats, particular options and parameters at each layer of the Bluetooth protocol stack, etc. For example, a Bluetooth specification may include various profiles that define the behavior associated with each communication endpoint to implement a specific use case. Profiles may thus generally be defined according to a protocol stack that promotes and allows interoperability between endpoint devices from different manufacturers through enabling applications to discover and use services that other nearby Bluetooth devices may be offering. The Bluetooth specification defines device role pairs that together form a single use case called a profile. One example profile defined in the Bluetooth specification is the Handsfree Profile (HFP) for voice telephony, in which one device implements an Audio Gateway (AG) role and the other device implements a Handsfree (HF) device role. Another example is the Advanced Audio Distribution Profile (A2DP) for high-quality audio streaming, in which one device (e.g., device 110-*a*) implements an audio source device (SRC) role and another device (e.g., paired device 115-*a*) implements an audio sink device (SNK) role.

For a commercial Bluetooth device that implements one role in a profile to function properly, another device that implements the corresponding role must be present within the radio range of the first device. For example, in order for an HF device such as a Bluetooth headset to function according to the Handsfree Profile, a device implementing the AG role (e.g., a cell phone) must be present within radio range. Likewise, in order to stream high-quality mono or stereo audio according to the A2DP, a device implementing the SNK role (e.g., Bluetooth headphones or Bluetooth speakers) must be within radio range of a device implementing the SRC role (e.g., a stereo music player).

The Bluetooth specification defines a layered data transport architecture and various protocols and procedures to handle data communicated between two devices that implement a particular profile use case. For example, various logical links are available to support different application data transport requirements, with each logical link associated with a logical transport having certain characteristics (e.g., flow control, acknowledgement/repeat mechanisms, sequence numbering, scheduling behavior). The Bluetooth protocol stack is split in two parts: a "controller stack" containing the timing critical radio interface, and a "host stack" dealing with high level data. The controller stack is generally implemented in a low cost silicon device containing the Bluetooth radio and a microprocessor. The controller stack may be responsible for setting up links 135 such as asynchronous connection-less (ACL) links, synchronous connection orientated (SCO) links, etc. Further, the controller stack may implement link management protocol (LMP) functions, low energy link layer (LE LL) functions, etc.

The host stack is generally implemented as part of an operating system, or as an installable package on top of an operating system. The host stack may be responsible for logical link control and adaptation protocol (L2CAP) functions, Bluetooth network encapsulation protocol (BNEP) functions, service discovery protocol (SDP) functions, etc. In some cases, the controller stack and the host stack may communicate via a host controller interface (HCI). In other cases, (e.g., for integrated devices such as Bluetooth headsets), the host stack and controller stack may be run on the same microprocessor to reduce mass production costs. For such "hostless systems," the HCI may be optional, and may be implemented as an internal software interface.

A link 135 established between two Bluetooth devices (e.g., between a master device 130 and a paired device 115) may provide for communications or services (e.g., according to some Bluetooth profile). For example, a Bluetooth connection may be an extended synchronous connection orientated (eSCO) link for voice call (e.g., which may allow for retransmission), an ACL link for music streaming (e.g., A2DP), etc. For example, eSCO packets may be transmitted in predetermined time slots (e.g., 6 Bluetooth slots each for eSCO). The regular interval between the eSCO packets may be specified when the Bluetooth link is established. The eSCO packets to/from a specific slave device (e.g., a paired device 115) are acknowledged, and may be retransmitted if not acknowledged during a retransmission window. In addition, audio content and control may be streamed between the master device 130 and paired devices 115-*a*, 115-*b* using an ACL link (A2DP profile). In some cases, the ACL link may occupy 1, 3, or 5 Bluetooth slots for data or voice. Other Bluetooth profiles supported by Bluetooth devices may include Bluetooth Low Energy (BLE) (e.g., providing considerably reduced power consumption and cost while maintaining a similar communication range), human interface device profile (HID) (e.g., providing low latency links with low power requirements), etc.

In some cases, a device may be capable of both Bluetooth and WLAN communications. For example, WLAN and Bluetooth components may be co-located within a device, such that the device may be capable of communicating according to both Bluetooth and WLAN communication protocols, as each technology may offer different benefits or may improve user experience in different conditions. In some cases, Bluetooth and WLAN communications may share a same medium, such as the same unlicensed frequency medium. In such cases, a master device 130 may support WLAN communications via AP 105 (e.g., over communication links 120). The AP 105 and the associated devices (e.g., devices 110 and master device 130) may represent a basic service set (BSS) or an extended service set (ESS). The various devices in the network may be able to communicate with one another through the AP 105. For example, AP 105 may act as an intermediary for two devices, which may communicate with AP 105 via respective communication links 120. Or two devices may communicate with one another directly via a peer-to-peer communication link. In some cases the AP 105 may be associated with a coverage area, which may represent a basic service area (BSA).

Devices 110, master devices 130, and APs 105 may communicate according to the WLAN radio and baseband protocol for physical and MAC layers from IEEE 802.11 and versions including, but not limited to, 802.11b, 802.11g, 802.11a, 802.11n, 802.11ac, 802.11ad, 802.11ah, 802.11ax, etc. In other implementations, peer-to-peer connections or ad hoc networks may be implemented within system 100. AP 105 may be coupled to a network, such as the Internet, and may enable a device 110 or master device 130 to communicate via the network (or communicate with other devices coupled to the AP 105). A device 110 or master device 130 may communicate with a network device bidirectionally. For example, in a WLAN, a device 110 or master device 130 may communicate with an associated AP 105 via downlink (e.g., the communication link from the AP 105 to the device) and uplink (e.g., the communication link from the device to the AP 105).

In some examples, content, media, graphics, audio, etc. exchanged between a master device 130 and a paired device 115 may originate from a WLAN. For example, in some cases, master device 130 may receive audio from an AP 105 (e.g., via WLAN communications), and the master device 130 may then implement the described techniques to relay or pass the audio to the paired device 115-*a*, 115-*b* (e.g., via Bluetooth communications). Similarly, master device 130 may receive graphics content from an AP 105 (e.g., via WLAN communications), and the master device 130 may then implement the described techniques to relay or pass the graphics content to the paired device 115-*c* (e.g., via Bluetooth communications). Alternatively, master device 130 may relay media content (e.g., graphics content, audio content) received from a content server such as an audio/video (A/V) streaming server. Regardless of the origin of the media content, master device 130 may transmit control information to the paired device that facilitates rendering of the content.

In some cases, paired devices 115-*a*, 115-*b* may be speakers that are part of a sound system (e.g., a surround sound system). In such cases, audio content may be provided to the speakers in the form of audio channels. Each audio channel may be a unique collection of sounds (compared to the other audio channels). The surround sound system may be configured to provide an ideal (e.g., immersive) sound experience to a user within a particular area covered by the sound system. For example, the channel mapped to each paired device 115-*a*, 115-*b* may be selected so that one or more users located between the two paired devices 115-*a*, 115-*b* has an immersive acoustic experience. But if the person moves from that location, the immersive quality, or other quality of the sound experience, may be reduced or lost.

According to the techniques described herein, a sound system may preserve the immersive nature of a user's auditory experience by adaptively reconfiguring its channel mapping and/or volume (among other parameters) in response to the user's movement. For example, a master device 130 may reconfigure the channel(s) mapped to one or more speakers within the sound system so each reconfigured speaker outputs a channel previously output by a different speaker. In some cases, the master device 130 may also adjust the sound level output (e.g., decibel (dB) level) by the reconfigured speakers (e.g., based on the user's new location or head position). In some cases, additionally or alternatively, the master device 130 may also adjust one or more other parameters associated with the sound system (e.g., speaker orientation, audio delay, bass, and/or treble).

Although described with reference to Bluetooth communications, the techniques described herein can be implemented using an suitable wired or wireless communication protocol.

Figure 2:
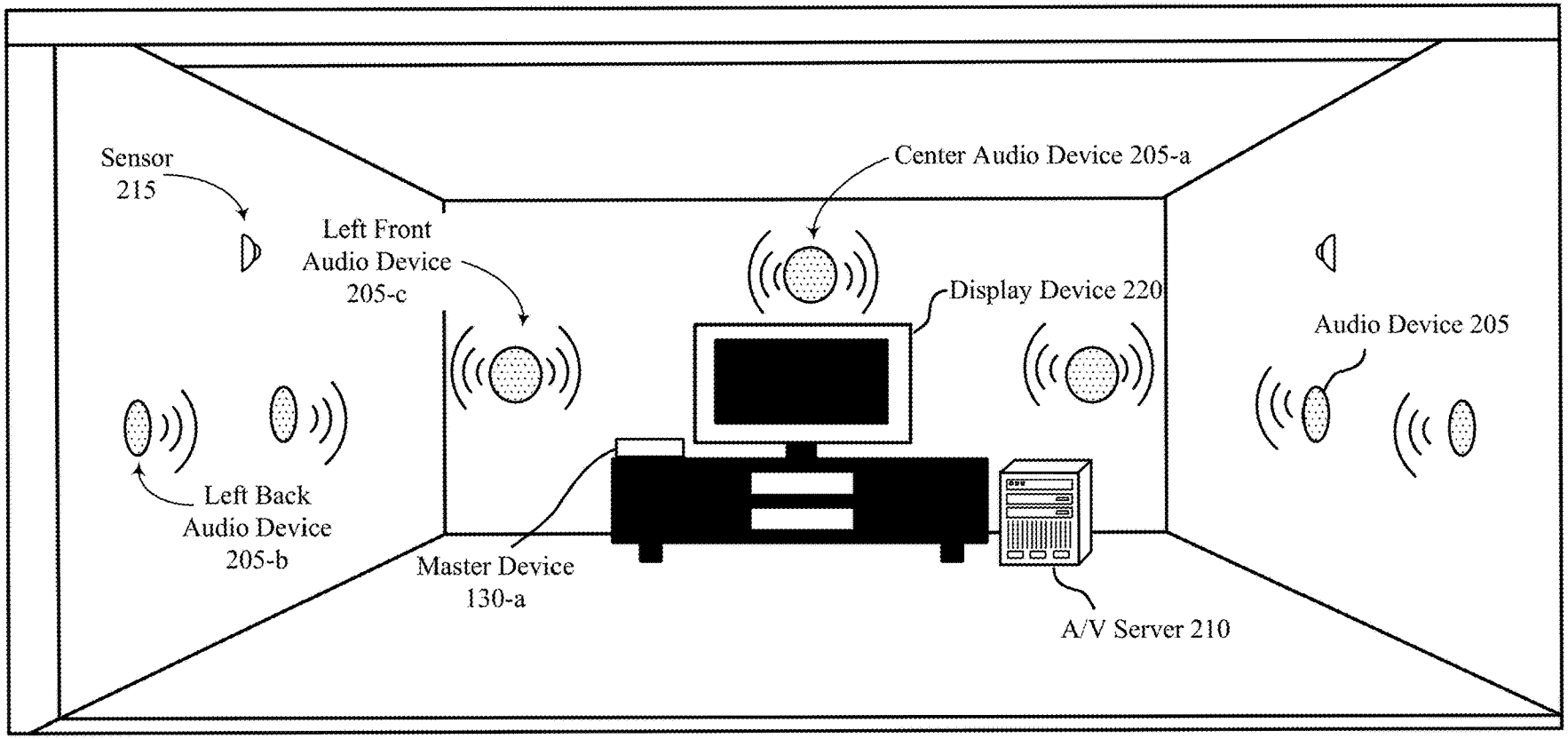
FIG. 2 illustrates an example sound system that supports immersive sound effects based on tracked position in accordance with aspects of the present disclosure.

FIG. 2 illustrates an example sound system 200 that supports immersive sound effects based on tracked position in accordance with aspects of the present disclosure. Sound system 200 may include a master device 130-*a* (e.g., a smart speaker controller) and one or more audio devices 205, which may be examples of, but are not limited to, one or more paired devices 115 described with reference to FIG. 1. Although shown as integrated (e.g., mounted) speakers, the audio devices 205 can be any devices capable of outputting audio content. The devices within sound system 200 may communicate over one or more wireless communication protocols such Bluetooth, Wi-Fi, ZigBee, etc., or over a wired communication protocol, or both.

Sound system 200 may also include an A/V server 210, which may provide (e.g., stream) audio content and/or graphics content to devices capable of rendering such content (e.g., A/V server 210 may stream audio content to audio device 205 and graphics content to display device 220). Or A/V server 210 may provide content to master device 130-*a*, which may relay the content to one or more devices (e.g., audio devices 205 and/or display device 220). In some cases, master device 130-*a* may process aspects of the content before relaying the content. Additionally, sound system 200 may include or communicate with sensors 215 which may detect, among other things, the movement and body position of a user, including head orientation. In some cases, the master device 130-*a* may provide to the sensors 215 identifying characteristics of a person selected for monitoring.

Audio devices 205 may output content received from a source, such as master device 130-*a* or A/V server 210. For example, each audio device 205 may output one or more channels at a time, and those one or more channels may be received from master device 130-*a*, A/V server 210, or some other source. The audio channel output by each audio device 205 may be configured (e.g., statically configured) based on the quantity and/or placement of the audio devices 205 (e.g., the channel mapping for a 7.1 configuration may be different than the channel mapping for a 5.1 configuration). For example, center audio device 205-*a* may (e.g., exclusively in some cases) output the center audio channel (e.g., audio channel n), left back audio device 205-*b* may (e.g., exclusively in some cases) output the left back audio channel (e.g., audio channel y), left front audio device 205-*c* may (e.g., exclusively) output the left front audio channel (e.g., audio channel x), etc.

The conceptual (e.g., logical) pairing of an audio device 205 with an audio channel may be referred to herein as a channel mapping. As discussed, in some cases channel mapping may be a one-to-one mapping in which a single audio channel is mapped to a single audio device 205. In some cases channel mapping may be different from a one-to-one mapping (e.g., a two-to-one, a one-to-two) in which a single audio channel is mapped to a single audio device 205. In some cases, the master device 130-*a* (as one example) may implement a new channel mapping by streaming (or instructing A/V server 210 to stream) at least one, at least two, and up to all, audio channels to the audio device 205 along with an indication of which audio channel each audio device 205 is to output. For example, the master device 130-*a* may stream multiple audio channels to an audio device 205 (e.g., speaker) and indicate (e.g., via control signaling) which of those channels that particular speaker is to output. Alternatively, the master device 130-*a* may implement a new channel mapping by selecting a unique audio channel to be streamed to each audio device 205 as determined by the mapping.

The channel mapping of a sound system may be configured to provide an immersive (e.g., realistic) acoustic experience to a person at a particular location relative to the audio devices 205. For example, the channel mapping of sound system 200 may be configured to provide a high quality sound environment for a person at the center of the room (e.g., watching display device 220). But because the channel mapping is initially configured (e.g., statically configured), the quality of the sound experience may decrease if the person moves around the room, changes vertical position (e.g., standing, sitting on furniture, crouching on a floor), changes rotational position (e.g., rotates their head or body in a location), or some combination. For example, a person who moves to the back left area of the room may hear a combination of sounds that is less than ideal (e.g., unbalanced or unnatural). For instance, rather than primarily hearing the vocals and accompanying instruments of a live concert, the person may be overwhelmed by the crowd noise.

According to the techniques described herein, the channel mapping of a sound system may be configured (e.g., dynamically reconfigured) to accommodate movement or changes of a user. For example, the master device 130-*a* may detect when a user moves and modify the channel mapping based on the new location and/or body position of the user. The movement, location and/or body position of the user may be detected by analyzing data from one or more of the sensors 215, which may track the user. For example, sensors 215 may monitor a user of the sound system 200 and feed information indicative of the user's whereabouts to the master device 130-*a*. In some cases, the information from sensors 215 may also inform the master device 130-*a* of the user's head orientation or body position (e.g., whether the user is standing, lying, or sitting). The analytics of tracking a user and determining their location and/or body position may be performed at the sensors 215 or at the master device 130-*a*, or both. The term spatial position may refer to the spatial location of a person, the body orientation of a person, the head position of a person, or the rotational position of the user, or a combination thereof. The rotational position of a user may refer to direction faced by the user's body and/or head relative to a device (e.g., the master device 130-*a*) or another reference point.

Although shown as separate devices (e.g., external to master device 130-*a*), one or more of the sensors 215 may be integrated into the master device 130-*a* and/or one or more of the audio devices 205. When the sensors 215 are separate devices, the sensors 215 may communicate with the master device 130-*a* using the same communication protocol as the audio devices 205 or a different protocol. Examples of sensors include video cameras, thermal sensors (e.g., thermo-imaging cameras), infrared cameras, motion sensors, pressure sensors, etc. In some cases, the sensors 215 may be sensors (e.g., gyroscope, accelerometers) embedded in a device 110 (e.g., a mobile phone) carried by the user. Additionally or alternatively, location information may be provided by a location tracking application running on such a device. The master device 130-*a* may aggregate information from multiple sensors 215 to determine the spatial position of a user.

Although channel re-mapping may be used to accommodate multiple users at a time, the examples described herein are directed to a single user for ease of explanation. In a single-user implementation, the master device 130-*a* may select a single person to monitor and track. For instance, the master device 130-*a* may identify a person (e.g., a person within the same room as the sound system 200) as a user targeted for an immersive sound experience. In some cases, the master device 130-*a* may identify the person as the user based on information from the sensors 215. For example, the master device 130-*a* may use information from the sensors 215 to perform facial detection, body detection, and/or facial recognition, among other methods.

When a single person is in the room, the master device 130-*a* may select that person for an immersive sound experience based on facial detection of body detection. In such cases, facial detection or body detection may be sufficient to identify the target (e.g., distinguish the user from other objects or non-human beings). When multiple people are in the room, the master device 130-*a* may select one of the people for an immersive sound experience based on facial recognition. For instance, the master device 130-*a* may distinguish the target from another person based on the facial features of the target. Alternatively, the master device 130-*a* may identify the target based on detection of a device carried by or coupled to the person (e.g., an RFID or mobile phone).

Figure 3A:
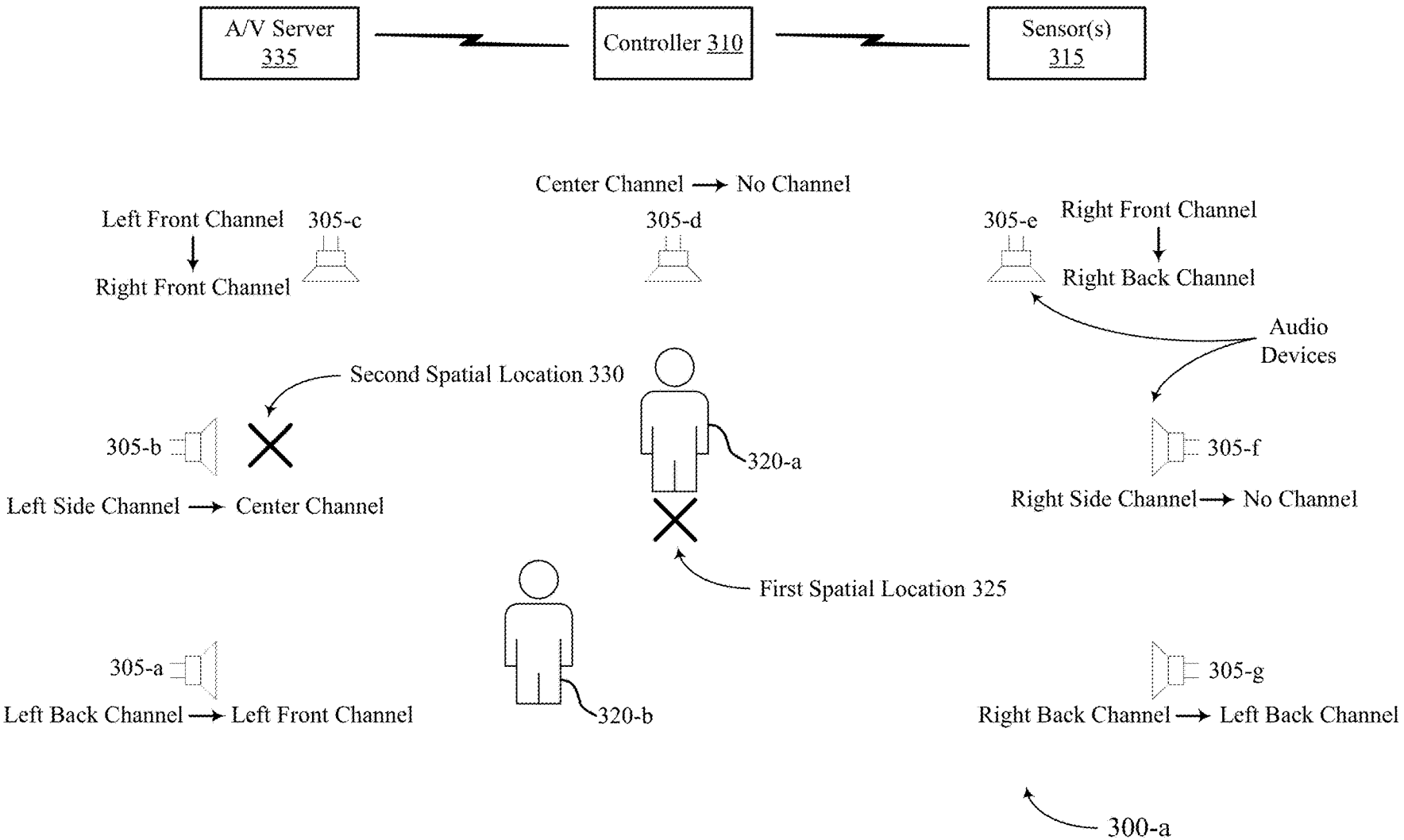
FIGS. 3A and 3B illustrate example sound systems that support immersive sound effects based on tracked position in accordance with aspects of the present disclosure.

FIG. 3A illustrates an example sound system 300-*a* that supports immersive sound effects based on tracked position in accordance with aspects of the present disclosure. Sound system 300-*a* may include a controller 310 (e.g., a smart speaker controller, which may be an example of a master device 130) and audio devices 305, which may be examples of audio devices 205 described with reference to FIG. 2. Sound system 300-*a* may also include an A/V server 335, which may be an example of an A/V server 210 described with reference to FIG. 2, and one or more sensors 315, which may be examples of sensors 215 described with reference to FIG. 2. In some cases sound system 300-*a* may include one or more additional audio components, such as subwoofers. The devices within sound system 300-*a* may communicate with each other or other devices via one or more wireless or wired communication protocols. Although shown as distinct devices, A/V server 335 and controller 310 may be co-located (e.g., A/V server 335 may be part of controller 310, or vice versa).

Sound system 300-*a* may be configured within an area (e.g., a room or several rooms) that can accommodate one or more people. When an object or being enters the area, or when the controller is turned on or activated from an idle state, the controller 310 may determine whether a person is within the area. For example, the controller 310 may receive from sensors 315 movement information that the controller 310 uses to detect the presence of one or more people. Movement information may refer to any data indicative of a person's location (e.g., where the person is in the area), positioning (e.g., the direction faced by the person, their body posture, etc.), or head orientation (e.g., the yaw, tilt, pitch of the person's head). Movement information may be received from the sensors 315 in response to a request from controller 310 or independent of such a request (e.g., the sensors 315 may be configured to automatically provide the movement information). Sensors 315 may be distributed throughout the area as independent devices or sensors 315 may be co-located with one or more of the other devices within the area (e.g., controller 310, A/V streaming service, or audio devices 305, among others).

If a single person is detected within the area, the controller 310 may select that person as the user (e.g., the person targeted for an immersive sound experience) of the sound system 300-*a*. When multiple people are detected, controller 310 may use the movement information to identify one of the people as the user. For instance, controller 310 may differentiate the user from the other people based on facial recognition (e.g., controller 310 may identify person 320-*a* as the user, as opposed to person 320-*b*). Or the user may be identified based on a device coupled with the person (e.g., an HMD, mobile device, RFID). If an animal is in the area, controller 310 may identify person 320-*a* as the user based on human body detection.

Once a user is determined, controller 310 may reconfigure the sound system 300-*a* based on the user's spatial position. For example, controller 310 may update the channel mapping and/or volume output of sound system 300-*a* to accommodate the user when the user moves from first spatial location 325 to second spatial location 330. Controller 310 may update the channel mapping and/or volume output by adjusting the channel and/or volume output by one or more audio devices 305. In some cases, updating the channel mapping may also include adjusting an audio device so that it outputs nothing (e.g., silence) or a filler signal (e.g., white noise).

As an example, given the movement of person 320-*a* (identified as the user) from first spatial location 325 to second spatial location 330, controller 310 may reconfigure the audio devices 305 as follows: audio device 305-*a* may be switched from outputting the left back channel to outputting the left front channel, audio device 305-*b* may be switched from outputting the left side channel to outputting the center channel, audio device 305-*c* may be switched from outputting the left front channel to outputting the right front channel, audio device 305-*d* may be switched from outputting the center channel to outputting no channel (e.g., nothing), audio device 305-*e* may be switched from outputting the right front channel to outputting the right back channel, audio device 305-*f* may be switched from outputting the right side channel to outputting no channel (e.g., nothing), and audio device 305-*g* may be switched from outputting the right back channel to outputting the left back channel. Thus, the audio channels of sound system 300-*a* may be re-mapped so that user 320-*a* continues to have an immersive sound experience even when the user moves around within the area.

In some cases, the volume output by one or more audio devices 305 may also be adjusted based on the user's spatial position, including the user's proximity to one or more audio devices 305. For example, although the center channel may be output at x dB when the user 320-*a* is at first spatial location 325, the center channel may be reduced to y dB when the user 320-*a* moves to second spatial location 330 (e.g., because the distance between second spatial location 330 and audio device 305-*b* is less than the distance between first spatial location and audio device 305-*d*.). Additionally or alternatively, the volume output by an audio device 305 may be adjusted based on the head orientation of the user 320-*a*.

The channel re-mapping techniques described herein may be particularly beneficial for virtual reality (VR), augmented reality (AR), mixed reality (MR), or extended reality (XR) applications. For example, when user 320-*a* is participating in an XR activity, A/V server 335 may stream graphics to an HMD worn by the user 320-*a*. Additionally, A/V server 335 may stream to audio devices 305 audio content (e.g., audio channels) that corresponds to the graphics. As the user 320-*a* moves around the area in response to the graphics displayed by the HMD, the techniques described herein can be used to adapt the sound environment to match the new locations of user 320-*a*. For instance, if the graphics displayed by the HMD show a waterfall directly in front of the user 320-*a*, the audio devices 305 may be controlled so that when the user 320-*a* approaches the waterfall, the sound of the waterfall gets louder. Thus, the realistic quality of the XR experience may be enhanced.

Figure 3B:
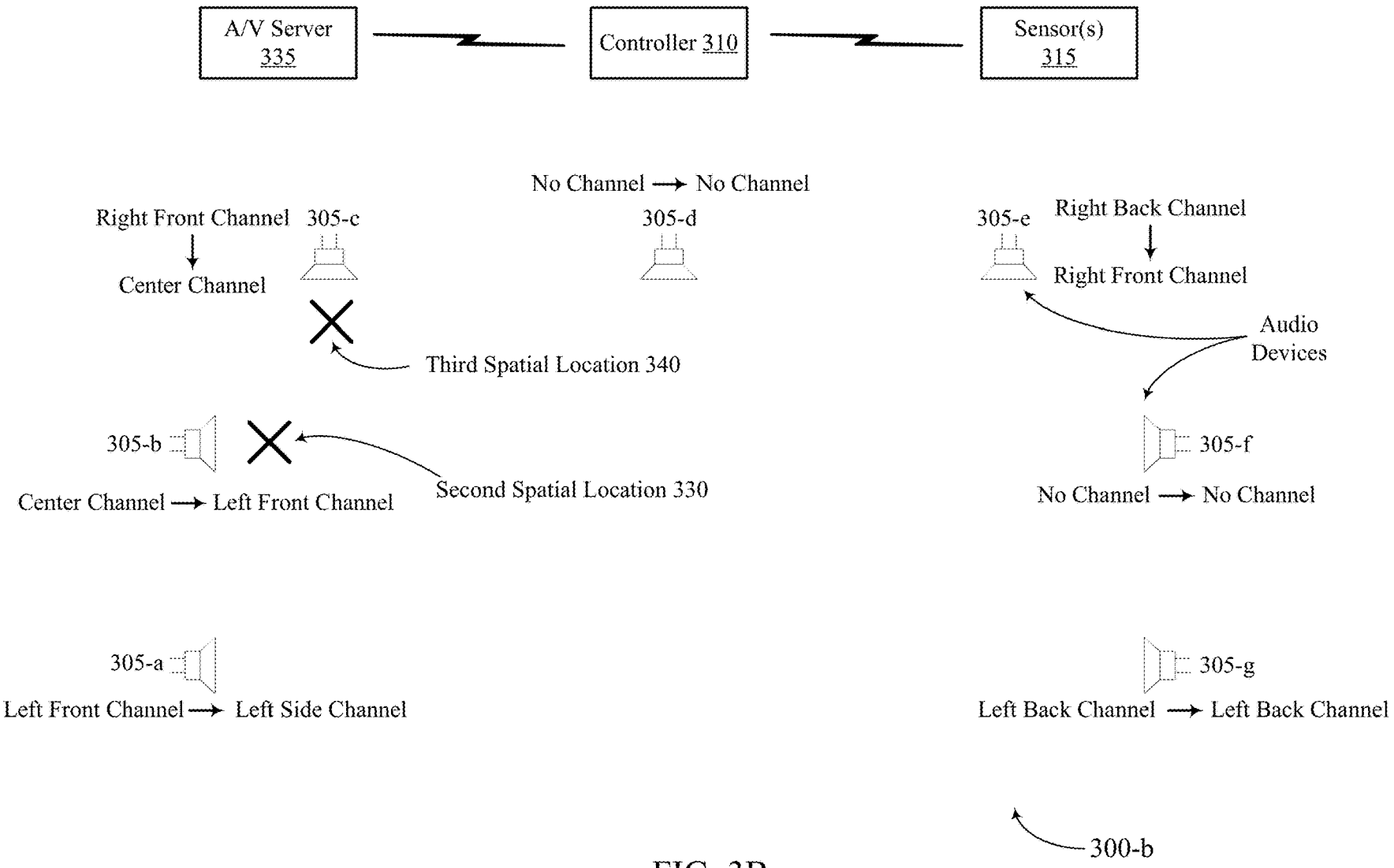

FIG. 3B illustrates an example sound system 300-*b* that supports immersive sound effects based on tracked position in accordance with aspects of the present disclosure. Sound system 300-*b* may be an example of sound system 300-*a* after, for example, the channel mapping has been updated to accommodate the user at second spatial location 330. Thus, sound system may include controller 310, audio devices 305, A/V server 335, and sensor(s) 315.

After the user has moved to second spatial location 330 and the channels and/or volume have been reconfigured (e.g., remapped) as described with reference to FIG. 3, the user may move to another location within the area (e.g., to third spatial location 425). As the user moves, the sound system 300-*b* may track the user as described herein. For example, the sensors 315 may monitor the area and/or or user and provide information indicative of the user's movement to controller 310. Based on the information from the sensors 315, controller 310 may determine that the user has moved from second spatial location 330 to third spatial location 340. In response to this determination, controller 310 may dynamically reconfigure the audio devices 305.

For instance, in the given example, controller 310 may reconfigure the audio devices 305 as follows: audio device 305-*a* may be switched from outputting the left front channel to outputting the left side channel, audio device 305-*b* may be switched from outputting the center channel to outputting the left front channel, audio device 305-*c* may be switched from outputting the right front channel to outputting the center channel, and audio device 305-*e* may be switched from outputting the right back channel to outputting the right front channel. However, audio devices 305-*d* and audio device 305-*f* may continue to output nothing (e.g., no audio channel), and audio device 305-*g* may continue to output the left back channel. Thus, at least some of the audio channels and audio devices 305 may be re-mapped so that user 320-*a* continues to have an immersive sound experience even when the user moves around within the area.

In some cases, the volume output by one or more audio devices 305 may also be adjusted. The volume adjustment may be based on the channel selected for the audio device 305, the head orientation of the user, and/or the new spatial position of the user. For example, the volume output by audio device 305-*c* may be selected to be a different level than previously output when the third spatial location 340 is determined to be within a threshold distance of audio device 305-*c*. As described above, the channel selected to be output by an audio device 305 may also be selected based on the proximity of the user's spatial location (e.g., based on the user's spatial location being within a threshold distance from the audio device 305).

In another example, the volume output by an audio device 305 may adjusted based on a change in the head orientation of the user. For example, when audio device 305-*c* is selected to output the center channel, audio device 305-*c* may also be selected to output the center channel at x dB. The initial volume level of x dB may be based at least in part on the head orientation of the user. If the user changes head orientation (e.g., turns their head to the left), controller 310 may react to the change by increasing or decreasing the sound level output by audio device 305-*c* (e.g., by selecting audio device 305-*c* to output y dB). Thus, the sound system 200 may accommodate even small changes in a user's body position.

Figure 4:
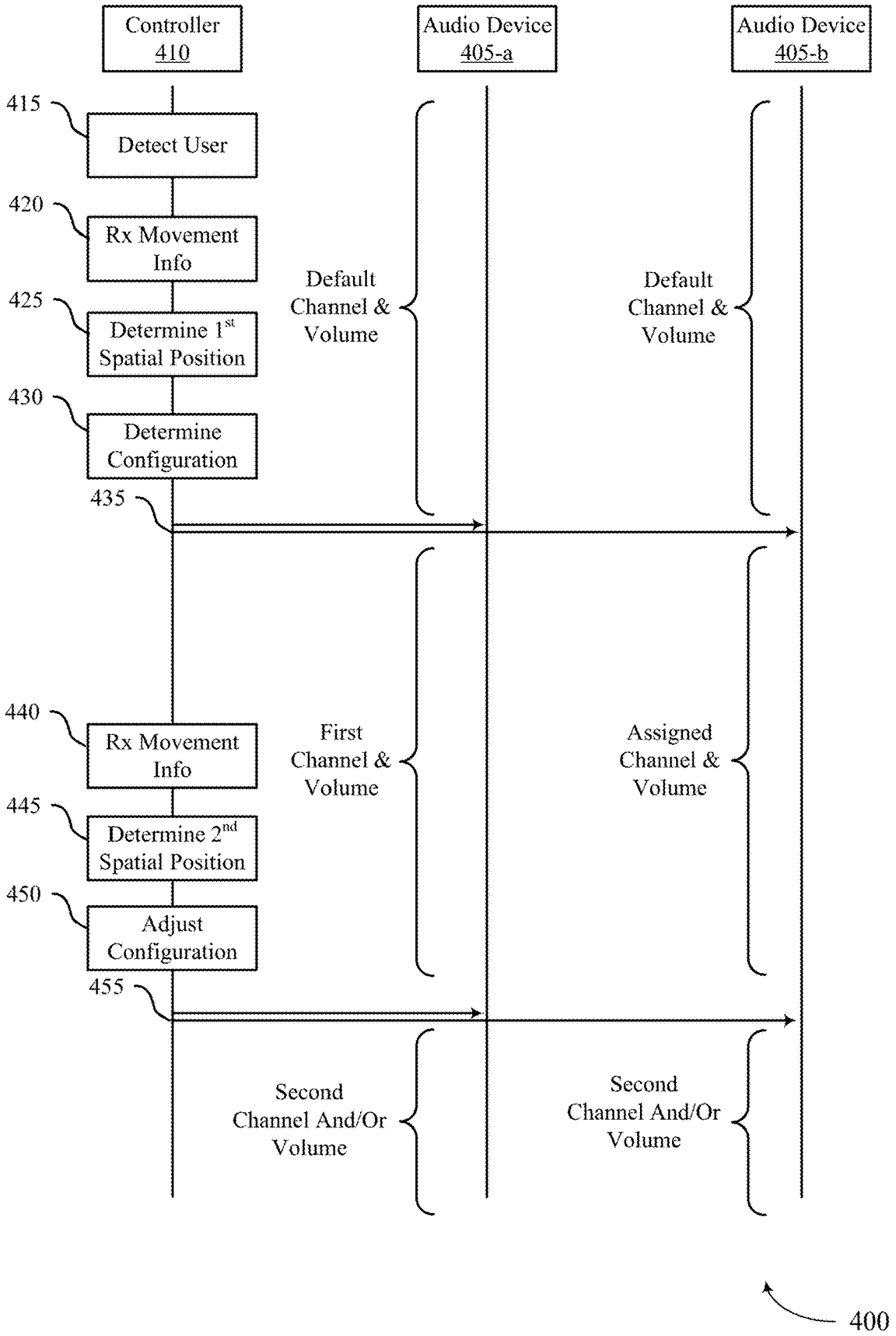
FIG. 4 illustrates an example of a process flow supports immersive sound effects based on tracked position in accordance with aspects of the present disclosure.

FIG. 4 illustrates an example of a process flow 400 supports immersive sound effects based on tracked position in accordance with aspects of the present disclosure. In some examples, process flow 400 may implement aspects of a sound system 300. Process flow 400 may illustrate operations conducted by a controller 410, which may be an example of a controller 310 described with reference to FIGS. 3A and 3B, or any other device. In the following description of the process flow 400, the passing of information between controller 410 and the audio devices 405 may be performed in a different order than the exemplary order shown, or the operations performed by controller 410 and the audio devices 405 may be performed in different orders or at different times. In some cases, certain operations may also be omitted from the process flow 400, or other operations may be added to the process flow 400. Although shown with two audio devices 405, the techniques described in process flow 400 can be implemented using any quantity of audio devices 405.

At 415, controller 410 may detect a user of the sound system. Controller 410 may detect the user based on information from one or more sensors, devices, or applications. In some cases, detecting the user may include identifying the user as a particular person when multiple people are in the area or from a group of stored identities. At 420, controller 410 may receive movement information corresponding to the user. The movement information may be received from one or more sensors internal or external to controller 410. At 425, controller 410 may determine the spatial position (e.g., a first spatial position) of the user based on the movement information. The first spatial position may be or include a first spatial location of the user, a first rotational position of the user, and/or a first head orientation of the user.

At 430, controller 410 may determine a configuration for audio devices 405. For example, controller 410 may determine the audio channel and volume to be output by each audio device 405. This may include selecting audio device 405-*a* (e.g., a first speaker) to output a first channel at a first sound level based at least in part on the first spatial position of the user. In some cases, controller 410 may also select audio device 405-*b* (e.g., a second speaker) to output a second channel based at least in part on the first spatial position of the user.

In some cases (e.g., when the first spatial position represents a first spatial location), controller 410 may determine the configuration based on the proximity of the first spatial location to audio device 405-*a*. For example, controller 410 may select audio device 405-*a* (e.g., the first speaker) to output the first channel based at least in part on the determination that the first spatial location is within the first threshold distance of audio device 405-*a*.

At 435, controller 410 may inform each audio device 405 of its new audio channel and volume as determined at 430. For example, controller 410 may send one or more signals to the audio devices 405 indicating the audio channel and volume to be output at each device. The signals may be unicast or broadcast. Up until 435, audio device 405-*a* and audio device 405-*b* may output assigned default audio channels, or no audio channels at all. After 435, each audio devices 405 may output its respective audio channel at its respective volume as indicated by the signaling at 435. For example, audio device 405-*a* may output the first channel at the first sound level. And audio device 405-*a* may output its assigned channel at its assigned volume.

At 440, controller 410 may receive updated movement information from the sensors and/or other devices. At 445, controller 415 may determine, based at least in part on the movement information, that the user moved from the first spatial position to a second spatial position in the area. Accordingly, at 450, controller 415 may adjust the configuration of the audio devices 405 based at least in part on determining that the user moved from the first spatial position to the second spatial position (e.g., in the area). For example, controller 415 may adjust audio device 405-*a* to output a second channel different than the first channel. Additionally or alternatively, controller 415 may adjust audio device 405-*a* to output a second sound level different than the first sound level. Controller 415 may also adjust the channel and/or sound level of audio device 405-*b*, among other aspects.

In some cases (e.g., when the first spatial position represents a first spatial location of the user and the second spatial position represents a second spatial location of the user), controller 410 may adjust the configuration by selecting audio device 405-*b* (e.g., a second speaker) to output the first channel. In such cases, controller 410 may select an addition audio device (e.g., a third speaker) to output the channel previously output by the second speaker based at least in part on the second spatial location.

In some cases (e.g., when the second spatial position represents a spatial location of the user and a head orientation of the user), controller 410 may adjust the configuration by selecting audio device 405-*a* (e.g., the first speaker) to output the second channel based at least in part on the spatial location of the user. Controller 410 may also select audio device 405-*a* (the first speaker) to output the second sound level based at least in part on the second channel and the head orientation of the user. If the head orientation of the user later changes, controller 410 may adjust the sound level of audio device 405-*a* (the first speaker) to be a third sound level.

In some cases (e.g., when the first spatial position represents a first head orientation of the user and the second spatial position represents a second head orientation of the user), controller 410 may select audio device 405-*a* (e.g., the first speaker) to output the first channel at the second sound level based at least in part on the second head orientation of the user.

In some examples (e.g., when the second spatial position represents a second spatial location), controller 410 may determine the new configuration based on the proximity of the second spatial location to audio device 405-*b* (e.g., the second speaker). For instance, controller 410 may select audio device 405-*b* (e.g., the second speaker) to output the first channel based at least in part on the determination that the second spatial location is within the second threshold distance of audio device 405-*b*.

At 455, controller 410 may transmit to the audio devices 405 an indication of the adjusted configuration. In response to the indication, audio devices 405 may adjust their outputs. For example, audio device 405-*a* may output the second channel and/or the second volume. And audio device 405-*b* may output its updated channel and/or volume, among other aspects or parameters.

Figure 5:
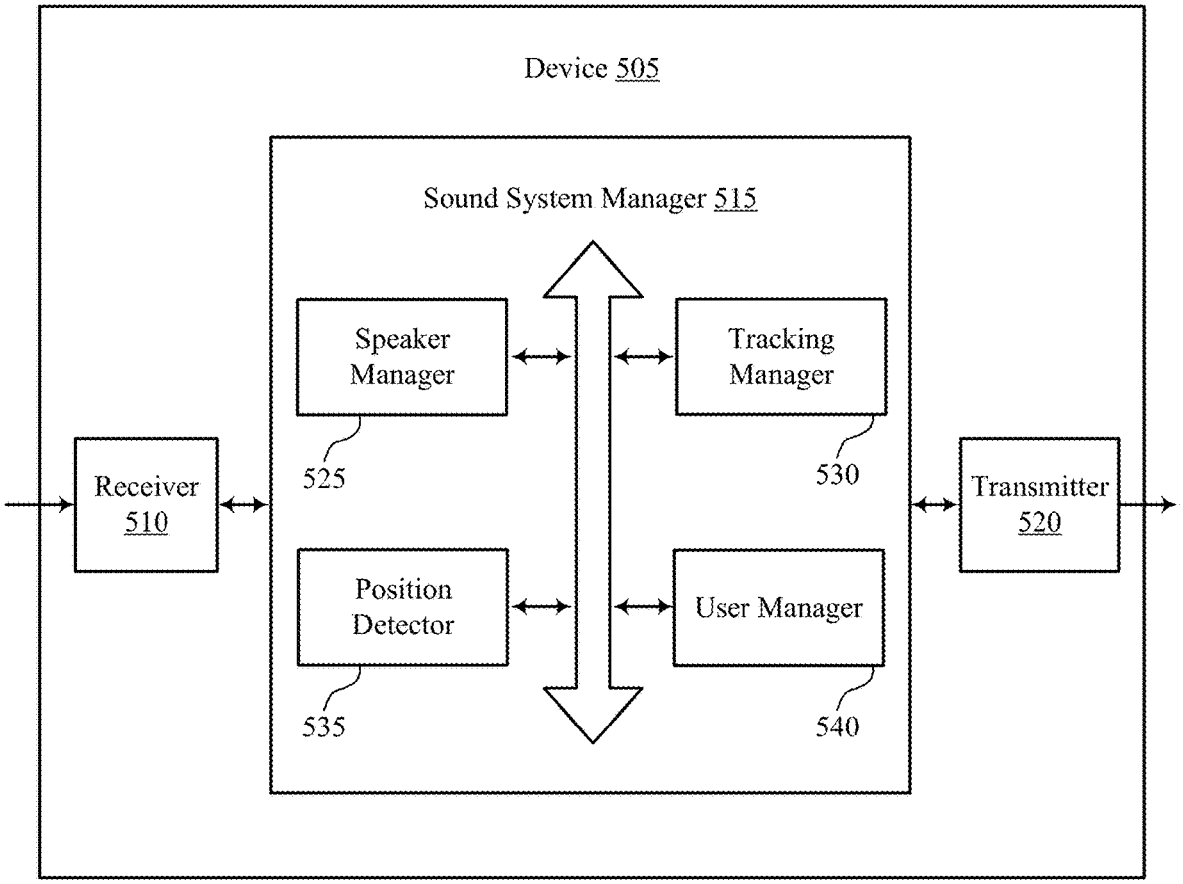
FIG. 5 shows a block diagram of a device that supports immersive sound effects based on tracked position in accordance with aspects of the present disclosure.

FIG. 5 shows a block diagram 500 of a device 505 that supports immersive sound effects based on tracked position in accordance with aspects of the present disclosure. The device 505 may be an example of aspects of a master device or controller as described herein. The device 505 may include a receiver 510, a sound system manager 515, and a transmitter 520. The device 505 may also include a processor. Each of these components may be in communication with one another (e.g., via one or more buses).

Receiver 510 may receive information such as packets, user data, or control information associated with various information channels (e.g., control channels, data channels, and information related to providing an immersive sound environment). Information may be passed on to other components of the device 505. The receiver 510 may be an example of aspects of the transceiver 620 described with reference to FIG. 6. The receiver 510 may utilize a single antenna or a set of antennas.

The sound system manager 515 may select a first speaker of a sound system in an area to output a first channel at a first sound level based at least in part on a first spatial position of a user. The sound system manager 515 may receive movement information associated with the user from one or more sensors in the area. The sound system manager 515 may determine, based at least in part on the movement information, that the user moved from the first spatial position to a second spatial position in the area. And the sound system manager 515 may adjust the first speaker to output a second channel different than the first channel, or a second sound level different than the first sound level, or both, based at least in part on determining that the user moved from the first spatial position to the second spatial position in the area.

The sound system manager 515, or its sub-components, may be implemented in hardware, code (e.g., software or firmware) executed by a processor, or any combination thereof. If implemented in code executed by a processor, the functions of the sound system manager 515, or its sub-components may be executed by a general-purpose processor, a DSP, an application-specific integrated circuit (ASIC), a FPGA or other programmable logic device, discrete gate or transistor logic, discrete hardware components, or any combination thereof designed to perform the functions described in the present disclosure.

The sound system manager 515, or its sub-components, may be physically located at various positions, including being distributed such that portions of functions are implemented at different physical locations by one or more physical components. In some examples, the sound system manager 515, or its sub-components, may be a separate and distinct component in accordance with various aspects of the present disclosure. In some examples, the sound system manager 515, or its sub-components, may be combined with one or more other hardware components, including but not limited to an input/output (I/O) component, a transceiver, a network server, another computing device, one or more other components described in the present disclosure, or a combination thereof in accordance with various aspects of the present disclosure.

The sound system manager 515 may be an example of aspects of the sound system manager 610 as described herein. The sound system manager 515 may include a speaker manager 525, a tracking manager 530, a position detector 535, and a user manager 540.

The speaker manager 525 may determine audio channel and volume configurations for speakers of a sound system in an area. The configurations may be based on the spatial position of a user. For example, the speaker manager 525 may select a first speaker of the sound system to output a first channel at a first sound level based at least in part on a first spatial position of the user. The first speaker may be selected to output the first channel while the user is in the first spatial position. The speaker manager 525 may adjust the first speaker to output a second channel different than the first channel, a second sound level different than the first sound level, or both, based at least in part on determining that the user moved from the first spatial position to the second spatial position in the area. The first speaker may be selected to output the adjusted channel, sound level, or both, while the user is in the second spatial position.

In some examples, the speaker manager 525 may also select a second speaker to output the second channel based at least in part on the first spatial position of the user. In such cases, the speaker manager 525 may adjust the second speaker to not output a channel based at least in part on the second spatial position of the user.

In some cases (e.g., when the first spatial position represents a first spatial location and the second spatial position represents a second spatial location), the speaker manager 525 may select a second speaker to output the first channel based at least in part on determining that the user has moved from the first spatial location to the second spatial location. In such cases, the speaker manager 525 may also select a third speaker to output a channel previously output by the second speaker based at least in part on the second spatial location.

In some examples (e.g., when the second spatial position represents a spatial location of the user and a head orientation of the user), the speaker manager 525 may 1) select the first speaker to output the second channel based at least in part on the spatial location of the user, and/or 2) select the first speaker to output the second sound level based at least in part on the second channel and the head orientation of the user. In such cases, the speaker manager 525 may adjust the sound level of the first speaker to be a third sound level based at least in part on a change in the head orientation of the user.

In some cases (e.g., when the first spatial position represents a first head orientation of the user and the second spatial position represents a second head orientation of the user), the speaker manager 525 may select the first speaker to output the first channel at the second sound level based at least in part on the second head orientation of the user.

The tracking manager 530 may be responsible for tracking the movement of a user. Accordingly, tracking manager 530 may receive movement information associated with the user from one or more sensors in the area. In some cases, at least a portion of the movement information is received from a sensor integrated into an HMD within the area.

The position detector 535 may be responsible for determining the spatial position of a user. For example, the position detector 535 may determine the first spatial position of the user based at least in part on the detection of the body of the user, the face of the user, or a mobile device of the user. The position detector 535 may also determine, based at least in part on the movement information, that the user moved from the first spatial position to a second spatial position in the area. The first spatial position may be, include, or represent a first spatial location of the user, a first rotational position of the user, and/or a first head orientation of the user. Similarly, the second spatial position may be, include, or represent a second spatial location of the user, a second rotational position of the user, and/or a second head orientation of the user.

In some cases, the position detector 535 may determine that the first spatial position represents a first spatial location within a first threshold distance of the first speaker. In such cases, the speaker manager 525 may select the first speaker to output the first channel based at least in part on the determination that the first spatial location is within the first threshold distance of the first speaker. The position detector 535 may also determine that the second spatial position represents a second spatial location within a second threshold distance of a second speaker. In such cases, the speaker manager 525 may select the second speaker to output the first channel based at least in part on the determination that the second spatial location is within the second threshold distance of the second speaker.

The user manager 540 may identify a user from other livings things (e.g., persons or animals) in the area. In some cases, user manager 540 may detect or recognize the body of the user, the face of the user, or a mobile device of the user.

Transmitter 520 may transmit signals generated by other components of the device. In some examples, the transmitter 520 may be collocated with a 510 in a transceiver module. For example, the transmitter 520 may be an example of aspects of the transceiver 620 described with reference to FIG. 6. The transmitter 520 may utilize a single antenna or a set of antennas.

Figure 6:
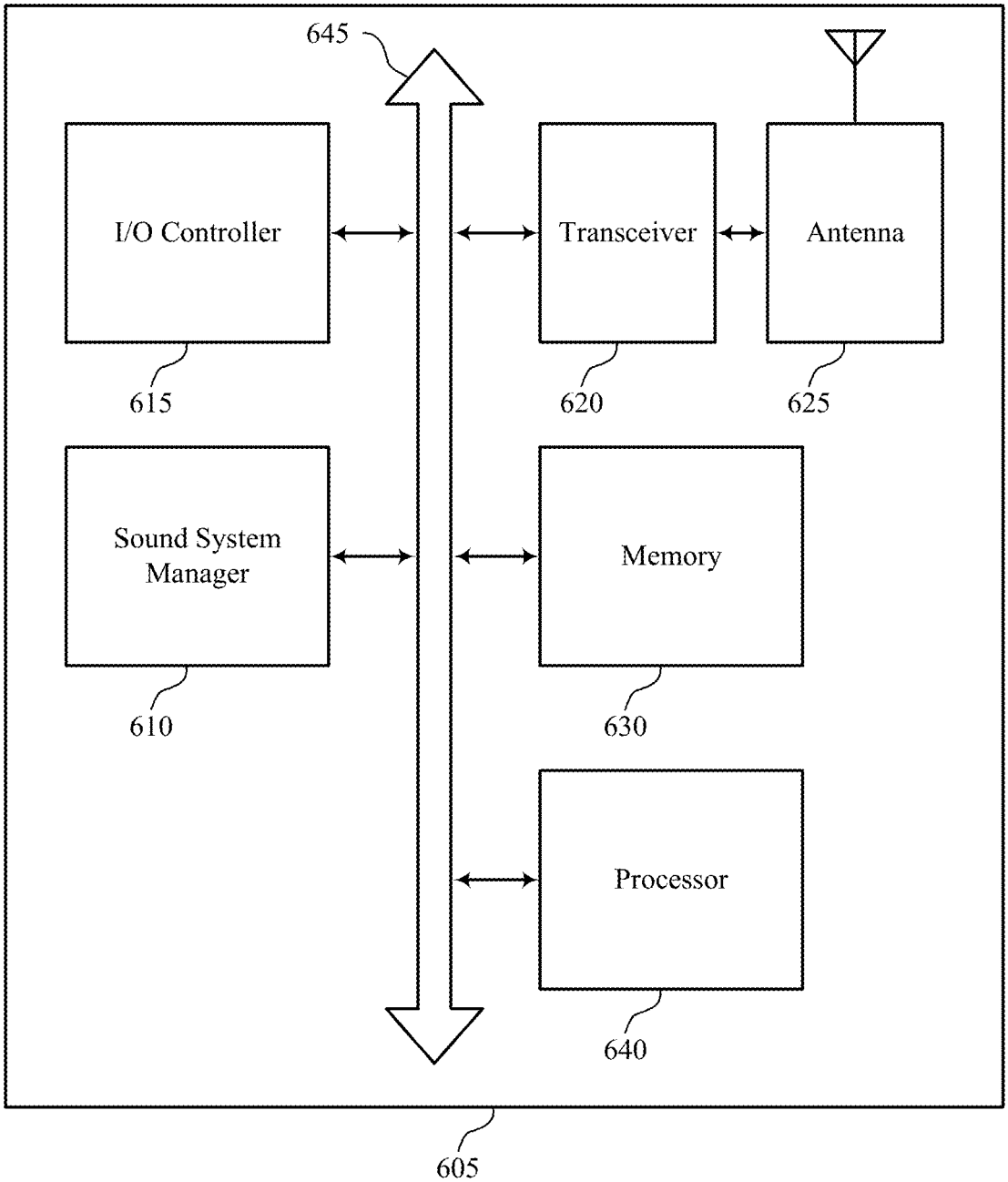
FIG. 6 shows a diagram of a system including a device that supports immersive sound effects based on tracked position in accordance with aspects of the present disclosure.

FIG. 6 shows a diagram of a system 600 including a device 605 that supports immersive sound effects based on tracked position in accordance with aspects of the present disclosure. The device 605 may be an example of or include the components of a master device or controller as described herein. The device 605 may include components for bi-directional voice and data communications including components for transmitting and receiving communications, including a sound system manager 610, an I/O controller 615, a transceiver 620, an antenna 625, memory 630, and a processor 640. These components may be in electronic communication via one or more buses (e.g., bus 645).

The sound system manager 610 may select a first speaker of a sound system in an area to output a first channel at a first sound level based at least in part on a first spatial position of a user. The sound system manager 610 may receive movement information associated with the user from one or more sensors in the area. The sound system manager 610 may determine, based at least in part on the movement information, that the user moved from the first spatial position to a second spatial position in the area. And the sound system manager 610 may adjust the first speaker to output a second channel different than the first channel, or a second sound level different than the first sound level, or both, based at least in part on determining that the user moved from the first spatial position to the second spatial position in the area.

I/O controller 615 may manage input and output signals for device 605. I/O controller 615 may also manage peripherals not integrated into device 605. In some cases, I/O controller 615 may represent a physical connection or port to an external peripheral. In some cases, I/O controller 615 may utilize an operating system such as iOS®, ANDROID®, MS-DOS®, MS-WINDOWS®, OS/2®, UNIX®, LINUX®, or another known operating system. In other cases, I/O controller 615 may represent or interact with a modem, a keyboard, a mouse, a touchscreen, or a similar device. In some cases, I/O controller 615 may be implemented as part of a processor. In some cases, a user may interact with device 605 via I/O controller 615 or via hardware components controlled by I/O controller 615.

Transceiver 620 may communicate bi-directionally, via one or more antennas, wired, or wireless links as described above. For example, the transceiver 620 may represent a wireless transceiver and may communicate bi-directionally with another wireless transceiver. The transceiver 620 may also include a modem to modulate the packets and provide the modulated packets to the antennas for transmission, and to demodulate packets received from the antennas.

In some cases, the wireless device may include a single antenna 625. However, in some cases the device may have more than one antenna 625, which may be capable of concurrently transmitting or receiving multiple wireless transmissions.

Memory 630 may include RAM and ROM. The memory 630 may store computer-readable, computer-executable software including instructions that, when executed, cause the processor to perform various functions described herein. In some cases, the memory 630 may contain, among other things, a BIOS which may control basic hardware or software operation such as the interaction with peripheral components or devices.

Processor 640 may include an intelligent hardware device, (e.g., a general-purpose processor, a CPU, a microcontroller, an ASIC, an FPGA, a programmable logic device, a discrete gate or transistor logic component, a discrete hardware component, or any combination thereof). In some cases, processor 640 may be configured to operate a memory array using a memory controller. In other cases, a memory controller may be integrated into processor 640. Processor 640 may be configured to execute computer-readable instructions stored in a memory to perform various functions (e.g., functions or tasks supporting the dynamic configuration of a sound system).

Figure 7:
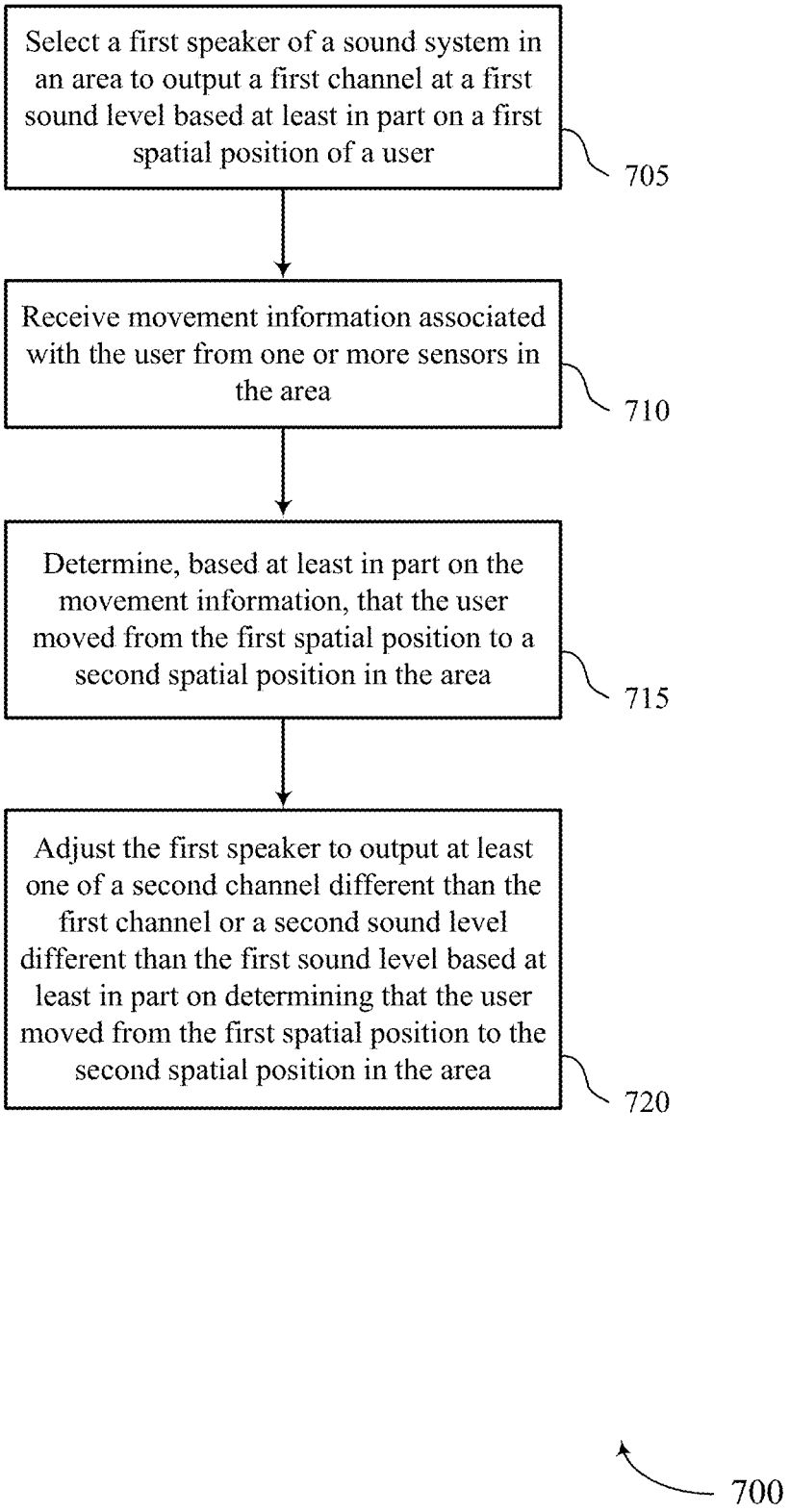
FIG. 7 shows a flowchart illustrating a method that supports immersive sound effects based on tracked position in accordance with aspects of the present disclosure.

FIG. 7 shows a flowchart illustrating a method 700 that supports immersive sound effects based on tracked position in accordance with aspects of the present disclosure. The operations of method 700 may be implemented by a controller or its components as described herein. For example, the operations of method 700 may be performed by a sound system manager as described with reference to FIGS. 5 and 6. In some examples, a device may execute a set of instructions to control the functional elements of the device to perform the functions described below. Additionally or alternatively, a device may perform aspects of the functions described below using special-purpose hardware.

At 705, the method may include selecting a first speaker of a sound system in an area to output a first channel at a first sound level based at least in part on a first spatial position of a user. The operations of 705 may be performed according to the methods described herein. In some examples, aspects of the operations of 705 may be performed by a speaker manager 525 as described with reference to FIG. 5.

At 710, the method may include receiving movement information associated with the user from one or more sensors in the area. The operations of 710 may be performed according to the methods described herein. In some examples, aspects of the operations of 710 may be performed by a tracking manager 530 as described with reference to FIG. 5.

At 715, the method may include determining, based at least in part on the movement information, that the user moved from the first spatial position to a second spatial position in the area. The operations of 715 may be performed according to the methods described herein. In some examples, aspects of the operations of 715 may be performed by a position detector 535 as described with reference to FIG. 5.

At 720, the method may include adjusting the first speaker to output at least one of a second channel different than the first channel or a second sound level different than the first sound level based at least in part on determining that the user moved from the first spatial position to the second spatial position in the area. The operations of 720 may be performed according to the methods described herein. In some examples, aspects of the operations of 720 may be performed by a speaker manager 525 as described with reference to FIG. 5.

It should be noted that the method described above describes possible implementations, and that the operations and the steps may be rearranged or otherwise modified and that other implementations are possible.

Techniques described herein may be used for various wireless communications systems such as code division multiple access (CDMA), time division multiple access (TDMA), frequency division multiple access (FDMA), orthogonal frequency division multiple access (OFDMA), single carrier frequency division multiple access (SC-FDMA), and other systems. The terms "system" and "network" are often used interchangeably. A code division multiple access (CDMA) system may implement a radio technology such as CDMA2000, Universal Terrestrial Radio Access (UTRA), etc. CDMA2000 covers IS-2000, IS-95, and IS-856 standards. IS-2000 Releases may be commonly referred to as CDMA2000 1×, 1×, etc. IS-856 (TIA-856) is commonly referred to as CDMA2000 1×EV-DO, High Rate Packet Data (HRPD), etc. UTRA includes Wideband CDMA (WCDMA) and other variants of CDMA. A time division multiple access (TDMA) system may implement a radio technology such as Global System for Mobile Communications (GSM). An orthogonal frequency division multiple access (OFDMA) system may implement a radio technology such as Ultra Mobile Broadband (UMB), Evolved UTRA (E-UTRA), IEEE 802.11 (Wi-Fi), IEEE 802.16 (WiMAX), IEEE 802.20, Flash-OFDM, etc.

The wireless communications system or systems described herein may support synchronous or asynchronous operation. For synchronous operation, the stations may have similar frame timing, and transmissions from different stations may be approximately aligned in time. For asynchronous operation, the stations may have different frame timing, and transmissions from different stations may not be aligned in time. The techniques described herein may be used for either synchronous or asynchronous operations.

The downlink transmissions described herein may also be called forward link transmissions while the uplink transmissions may also be called reverse link transmissions. Each communication link described herein—including, for example, system 100 of FIG. 1—may include one or more carriers, where each carrier may be a signal made up of multiple sub-carriers (e.g., waveform signals of different frequencies).

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form to avoid obscuring the concepts of the described examples.

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label.

Information and signals described herein may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and modules described in connection with the disclosure herein may be implemented or performed with a general-purpose processor, a DSP, an ASIC, an FPGA or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices (e.g., a combination of a DSP and a microprocessor, multiple microprocessors, one or more microprocessors in conjunction with a DSP core, or any other such configuration).

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope of the disclosure and appended claims. For example, due to the nature of software, functions described above may be implemented using software executed by a processor, hardware, firmware, hardwiring, or combinations of any of these. Features implementing functions may also be physically located at various positions, including being distributed such that portions of functions are implemented at different physical locations. Also, as used herein, including in the claims, "or" as used in a list of items (for example, a list of items prefaced by a phrase such as "at least one of" or "one or more of") indicates an inclusive list such that, for example, a list of at least one of A, B, or C means A or B or C or AB or AC or BC or ABC (i.e., A and B and C). Also, as used herein, the phrase "based on" shall not be construed as a reference to a closed set of conditions. For example, an exemplary step that is described as "based on condition A" may be based on both a condition A and a condition B without departing from the scope of the present disclosure. In other words, as used herein, the phrase "based on" shall be construed in the same manner as the phrase "based at least in part on."

Computer-readable media includes both non-transitory computer storage media and communication media including any medium that facilitates transfer of a computer program from one place to another. A non-transitory storage medium may be any available medium that can be accessed by a general purpose or special purpose computer. By way of example, and not limitation, non-transitory computer-readable media can comprise RAM, ROM, electrically erasable programmable read only memory (EEPROM), compact disk (CD) ROM or other optical disk storage, magnetic disk storage or other magnetic storage devices, or any other non-transitory medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, digital subscriber line (DSL), or wireless technologies such as infrared, radio, and microwave are included in the definition of medium. Disk and disc, as used herein, include CD, laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The description herein is provided to enable a person skilled in the art to make or use the disclosure. Various modifications to the disclosure will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

What is claimed is:

1. A method for providing adaptive acoustics, comprising:

determining that a first spatial position of a user comprises a first spatial location within a first threshold distance of a first speaker of a sound system in an area;

selecting the first speaker of the sound system in the area to output a first channel at a first sound level based at least in part on the first spatial position of the user, wherein selecting the first speaker to output the first channel is based at least in part on the determination that the first spatial location is within the first threshold distance of the first speaker;

receiving movement information associated with the user from one or more sensors in the area;

determining, based at least in part on the movement information, that the user moved from the first spatial position to a second spatial position in the area;

adjusting the first speaker to output at least one of a second channel different than the first channel or a second sound level different than the first sound level based at least in part on determining that the user moved from the first spatial position to the second spatial position in the area;

determining that the second spatial position comprises a second spatial location within a second threshold distance of a second speaker of the sound system; and selecting the second speaker to output the first channel based at least in part on the determination that the second spatial location is within the second threshold distance of the second speaker.

2. The method of claim 1, further comprising:

selecting a third speaker to output a channel previously output by the second speaker based at least in part on the second spatial location.

3. The method of claim 1, wherein the second spatial position comprises a head orientation of the user, and wherein adjusting the first speaker comprises:

selecting the first speaker to output the second channel based at least in part on the second spatial location of the user; and selecting the first speaker to output the second sound level based at least in part on the second channel and the head orientation of the user.

4. The method of claim 3, further comprising:

adjusting the sound level of the first speaker to be a third sound level based at least in part on a change in the head orientation of the user.

5. The method of claim 1, further comprising:

selecting a third speaker to output the second channel based at least in part on the first spatial position of the user; and adjusting the third speaker to not output a channel based at least in part on the second spatial position of the user.

6. The method of claim 1, wherein the first spatial position comprises a first head orientation of the user and the second spatial position comprises a second head orientation of the user, and wherein adjusting the first speaker comprises:

selecting the first speaker to output the first channel at the second sound level based at least in part on the second head orientation of the user.

7. The method of claim 1, wherein the first speaker is selected to output the first channel while the user is in the first spatial position and wherein the first speaker is selected to output at least one of the adjusted channel or sound level while the user is in the second spatial position.

8. The method of claim 1, further comprising:

detecting at least one of the body of the user, the face of the user, or a mobile device of the user; and determining the first spatial position of the user based at least in part on the detection.

9. The method of claim 8, further comprising:

identifying the user as one of at least two people within the area based at least in part on the detection.

10. The method of claim 1, wherein the first spatial position further comprises a first rotational position of the user or a first head orientation of the user, or both, and wherein the second spatial position further comprises a second rotational position of the user or a second head orientation of the user, or both.

11. The method of claim 1, wherein the one or more sensors comprise at least one sensor within a head mounted display (HMD) or a mobile device.

12. An apparatus for providing adaptive acoustics, comprising:

a processor;

memory in electronic communication with the processor; and instructions stored in the memory and executable by the processor to cause the apparatus to:

determine that a first spatial position of a user comprises a first spatial location within a first threshold distance of a first speaker of a sound system in an area;

select the first speaker of the sound system in the area to output a first channel at a first sound level based at least in part on the first spatial position of the user, wherein selecting the first speaker to output the first channel is based at least in part on the determination that the first spatial location is within the first threshold distance of the first speaker;

receive movement information associated with the user from one or more sensors in the area;

determine, based at least in part on the movement information, that the user moved from the first spatial position to a second spatial position in the area;

adjust the first speaker to output at least one of a second channel different than the first channel or a second sound level different than the first sound level based at least in part on determining that the user moved from the first spatial position to the second spatial position in the area;

determine that the second spatial position comprises a second spatial location within a second threshold distance of a second speaker of the sound system; and select the second speaker to output the first channel based at least in part on the determination that the second spatial location is within the second threshold distance of the second speaker.

13. The apparatus of claim 12, further comprising instructions executable by the processor to cause the apparatus to:

select a third speaker to output a channel previously output by the second speaker based at least in part on the second spatial location.

14. The apparatus of claim 12, wherein the second spatial position comprises a head orientation of the user, and wherein the instructions executable by the processor to cause the apparatus to adjust the first speaker comprise instructions executable by the processor to cause the apparatus to:

select the first speaker to output the second channel based at least in part on the second spatial location of the user; and select the first speaker to output the second sound level based at least in part on the second channel and the head orientation of the user.

15. The apparatus of claim 12, wherein the instructions executable to receive the movement information comprise instructions executable to receive the movement information from at least one sensor external to the apparatus.

16. A non-transitory computer readable medium storing code comprising instructions executable by a processor to:

determine that a first spatial position of a user comprises a first spatial location within a first threshold distance of a first speaker of a sound system in an area;

select the first speaker of the sound system in the area to output a first channel at a first sound level based at least in part on the first spatial position of the user, wherein selecting the first speaker to output the first channel is based at least in part on the determination that the first spatial location is within the first threshold distance of the first speaker;

receive movement information associated with the user from one or more sensors in the area;

determine, based at least in part on the movement information, that the user moved from the first spatial position to a second spatial position in the area;

adjust the first speaker to output at least one of a second channel different than the first channel or a second sound level different than the first sound level based at least in part on determining that the user moved from the first spatial position to the second spatial position in the area;

determine that the second spatial position comprises a second spatial location within a second threshold distance of a second speaker of the sound system; and select the second speaker to output the first channel based at least in part on the determination that the second spatial location is within the second threshold distance of the second speaker.

* * * * *